US007959088B2

(12) United States Patent
Bolus et al.

(10) Patent No.: US 7,959,088 B2
(45) Date of Patent: Jun. 14, 2011

(54) METHOD AND APPARATUS FOR PRODUCING DROPLET SPRAY

(75) Inventors: Robert Nicholas Edward Bolus, Auckland (NZ); Roger Alan Wheat, Auckland (NZ); Malcolm Shaun Craill, Auckland (NZ); Susan Myrtle Brownlie, Auckland (NZ); Neil Faragher, Auckland (NZ); Greg Nigel Brooking, Auckland (NZ); Steven Peter Morris, Auckland (NZ)

(73) Assignee: Methven Ltd., Auckland (NZ)

( * ) Notice: Subject to any disclaimer, the term of this patent is extended or adjusted under 35 U.S.C. 154(b) by 1596 days.

(21) Appl. No.: 10/845,482

(22) Filed: May 14, 2004

(65) Prior Publication Data

US 2005/0001072 A1 Jan. 6, 2005

(51) Int. Cl.

| | |
|---|---|
| ***A62C 2/08*** | (2006.01) |
| ***A62C 37/08*** | (2006.01) |
| ***B05B 1/14*** | (2006.01) |
| ***E21F 5/04*** | (2006.01) |
| ***F23D 11/38*** | (2006.01) |
| ***F23D 14/48*** | (2006.01) |
| *B05B 7/04* | (2006.01) |

(52) U.S. Cl. ..... 239/8; 239/544; 239/556; 239/433; 239/429; 239/548

(58) Field of Classification Search ..... 239/433, 239/434, 434.5, 548

See application file for complete search history.

(56) References Cited

U.S. PATENT DOCUMENTS

| | | | | | |
|---|---|---|---|---|---|
| 1,189,593 | A | | 7/1916 | Lynn | |
| 2,302,021 | A | * | 11/1942 | Freeman | 239/543 |
| 2,351,819 | A | | 6/1944 | Judell | |
| 2,492,037 | A | | 5/1945 | Freeman et al. | |
| 2,499,092 | A | * | 2/1950 | Burnam | 239/544 |
| 2,647,800 | A | * | 8/1953 | Burnam et al. | 239/543 |
| 2,785,926 | A | * | 3/1957 | Lataste | 239/438 |
| 2,795,462 | A | | 6/1957 | Bletcher et al. | |
| 2,812,213 | A | | 11/1957 | Bede | |
| 3,568,933 | A | | 3/1971 | MacGuire-Cooper | |
| 3,672,574 | A | | 6/1972 | Knapp | |
| 4,002,293 | A | | 1/1977 | Simmons | |
| 4,337,899 | A | | 7/1982 | Selberg | |
| 4,398,669 | A | * | 8/1983 | Fienhold | 239/447 |

(Continued)

FOREIGN PATENT DOCUMENTS

EP 08600210 8/1998

(Continued)

OTHER PUBLICATIONS

No. 154472, Spray Nozzle, The Dorman Sprayer, Co., Ltd. , Nov. 13, 1968, Great Britain.

(Continued)

*Primary Examiner* — Dinh Q Nguyen
*Assistant Examiner* — James S Hogan
(74) *Attorney, Agent, or Firm* — Dykema Gossett PLLC

(57) ABSTRACT

A spray head or spray head insert is provided for use in at least one of a shower head, an industrial spray head and an agricultural spray head including a plurality of groups of nozzles, each group of nozzles having at least two nozzles that are suitable for issuing jets of fluid from a surface of the spray head or spray head insert and are dimensioned and oriented, at least in use, so that fluid exiting the said at least two nozzles under pressure collides, interacts substantially unimpeded by surrounding structures and breaks into droplets.

12 Claims, 12 Drawing Sheets

U.S. PATENT DOCUMENTS

| | | | | |
|---|---|---|---|---|
| 4,783,008 | A | 11/1988 | Ikeuchi et al. | |
| 5,088,649 | A | 2/1992 | Hanson et al. | |
| 5,104,045 | A | 4/1992 | Kah, Jr. | |
| 5,249,747 | A | 10/1993 | Hanson et al. | |
| 5,358,179 | A | 10/1994 | Lund et al. | |
| 5,472,143 | A | 12/1995 | Bartels et al. | |
| 5,628,460 | A | 5/1997 | Chastang et al. | |
| 5,769,327 | A | 6/1998 | Kure et al. | |
| 5,918,811 | A * | 7/1999 | Denham et al. | 239/123 |
| 6,029,912 | A * | 2/2000 | Woolley | 239/428.5 |
| 6,250,572 | B1 * | 6/2001 | Chen | 239/602 |
| 2004/0026528 | A1 | 2/2004 | Jenkins | |

FOREIGN PATENT DOCUMENTS

| | | |
|---|---|---|
| EP | 0664733 | 8/1999 |
| EP | 0738174 | 4/2000 |
| GB | 438567 | 11/1935 |
| GB | 696787 | 9/1953 |
| GB | 1038638 | 8/1966 |
| GB | 1202040 | 8/1970 |
| GB | 2309180 | 7/1997 |
| GB | 2309181 A | 7/1997 |
| GB | 2309181 B | 7/1999 |
| JP | 55116460 | 9/1980 |
| JP | 6355988 | 11/1988 |
| JP | 668428 | 9/1994 |
| JP | 200278632 | 3/2002 |
| WO | WO 94/07607 | 4/1994 |
| WO | WO 01/89895 | 11/2001 |

OTHER PUBLICATIONS

No. 88,427, Nozzle, Nu-Swift Ltd., May 19, 1948.
No. 171,083, Nozzle and Apparatus for Spraying Liquid, Richard of Rockford, Inc., Jun. 18, 1973.

* cited by examiner

A

B

METHOD AND APPARATUS FOR PRODUCING DROPLET SPRAY

TECHNICAL FIELD

The present invention relates to spray heads for producing a spray of fluid and for use as a shower head, an industrial spray head and/or an agricultural spray head. The present invention may have particular application to a shower head.

BACKGROUND

Various spray heads have been developed to produce a spray of fluid. Spray heads have been used in agricultural and industrial applications, as well as in domestic applications, most typically in domestic showers, where various shower head designs have been proposed to provide a more pleasurable shower experience.

A problem with some existing shower heads includes an inability to adequately cope with varying fluid supply pressure. Therefore, the same shower head installed in systems having different pressures may provide very different spray characteristics, some of which may be unsatisfactory. This problem has lead to the design of specific high pressure and low pressure heads. However, it would be useful, at least for convenience to have a shower head that provided a satisfactory shower experience over a wide range of system pressures.

Water conservation is also an important consideration. Low volume flow shower heads provide water conservation. However, users often prefer the feeling of a high volume shower head. Therefore, there is a need for shower heads that provide a low volume flow while providing the sensation of a higher volume shower.

Also, there may be a demand for a shower head that provides an improved showering experience over existing shower heads to date.

It is therefore an object of the present invention to provide a spray head that overcomes or alleviates one or more problems in spray heads at present, and/or provides improvements over existing shower heads, or at least to provide the public with a useful alternative.

SUMMARY OF THE INVENTION

According to one aspect of the present invention there is provided a spray head or spray head insert for use in at least one of a shower head, an industrial spray head and an agricultural spray head including a plurality of groups of nozzles, each group of nozzles having at least two nozzles that are suitable for issuing jets of fluid from a surface of the spray head or spray head insert and are dimensioned and oriented, at least in use, so that fluid exiting the said at least two nozzles under pressure collides, interacts substantially unimpeded by surrounding structures and breaks into droplets.

Preferably, the at least two nozzles are oriented at an included angle of between approximately 40° and 140°, and more preferably, the at least two nozzles are oriented at an included angle of between approximately 70° and 85°.

Preferably, at least one of said plurality of nozzle groups are asymmetrical in order to provide, in use, a spray in a direction other than along an imaginary line at the selected nozzle group that is normal to the surface of the spray head or spray head insert. The at least one of said plurality of nozzle groups may have nozzles with differing cross-sectional area. Also, for at least one of said plurality of nozzle groups, the at least two nozzles may be oriented at a different angle relative to an imaginary line at the nozzle group that is normal to the surface of the spray head or spray head insert in order to provide, in use, a spray in a direction other than along said imaginary line.

The spray head or spray head insert may include nozzle groups that are symmetrical located in one or more predefined regions of the spray head or spray head insert and nozzle groups that are asymmetrical located in one or more other predefined regions of the spray head or spray head insert. The nozzle groups located toward the periphery of the spray head may be configured so that spray exiting the nozzle group travels away from the centre of the spray head after exiting the nozzle group.

In one embodiment the nozzle groups may be located in a non-planar base.

Preferably, at least selected nozzle groups are configured so that fluid exiting nozzles in said at least selected nozzle groups under pressure collides with less than 100% crossover.

Preferably, fluid exiting all nozzle groups of the spray head or spray head insert may collide under pressure with less than 100% cross-over. The percentage cross-over may be between approximately 20% and 80% or at least in some embodiments, the percentage cross-over may be between approximately 40% and 50%.

The exit aperture diameter of the nozzles in each nozzle group may between approximately 0.8 and 1.0 mm. The centres of the exit apertures of nozzles in each nozzle group may be separated by approximately 1.5 mm.

Preferably, at least two types of nozzle group having different sized nozzle exit diameters may be provided, wherein nozzle groups having larger nozzle exit diameters have a lesser percentage cross-over than nozzle groups having smaller exit diameters.

Preferably, the nozzles in each group of nozzles may be formed at least in part by an aperture formed in a flexible or elastic material. The flexible or elastic material forming said aperture may protrude out from the surface of the spray head.

Preferably, each group of nozzles consists of two nozzles. The entrances and exits of nozzles in at least selected nozzle groups may be offset relative to each other and in one embodiment may be offset so that fluid issues from the at least selected nozzle groups at an angle of between approximately 6 and 8 degrees to an imaginary line at the nozzle group normal to the surface of the spray head or spray head insert.

Preferably, each nozzle group may be formed by one or more apertures and one or more complimentary protrusions that together define a fluid flow path for each nozzle there between. Each nozzle group may be formed by two apertures and complimentary protrusions, wherein the protrusions act as a blank for each said aperture, thereby increasing the included angle of the jets issuing from the nozzles in the nozzle group. Each aperture may be substantially conical in shape. The protrusions may also be movable relative to the apertures to allow control over characteristics of spray produced by the spray head or spray head insert.

Preferably, the protrusions for a plurality of nozzle groups may all be formed in a single base material.

Preferably, the apertures for a plurality of nozzle groups may all be formed in a single base material.

Preferably, the protrusions can be removed from their corresponding apertures to provide access to the surface of the protrusions and apertures for cleaning.

Preferably, the nozzles in each nozzle group may be formed by a channel or groove in one or both of the aperture and protrusion.

Preferably, the spray head or spray head insert may be dimensioned and shaped to create, in use, turbulent fluid flow in each nozzle. Each nozzle may include at least one baffle to create the turbulent fluid flow.

The spray head or spray head insert may be particularly advantageous when it comprises part of a spray head forming a shower head.

According to a second aspect of the present invention, there is provided for at least one of a shower, industrial application process or agricultural application process, a method of producing a fluid spray formed by droplets of fluid, the method including passing fluid through a plurality of groups of nozzles located proximate each other, each group of nozzles including at least two nozzles oriented relative to each other so that fluid exiting nozzles in each nozzle group collides, interacts substantially unimpeded from surrounding structures and subsequently breaks into droplets.

Preferably, the method may include providing nozzles in said groups of nozzles that are oriented to have an included angle of between approximately 40° and 140°. More preferably, the method may include providing nozzles in said groups of nozzles that are oriented to have an included angle between approximately 70° and 85°.

Preferably, the method may include passing fluid through at least selected groups of nozzles that are asymmetrical in order to provide a spray from the selected nozzle groups at a required angle.

Preferably, each nozzle group may consist of two nozzles.

Preferably, the method may include passing a turbulent flow of fluid through each nozzle.

Preferably, the method may include directing fluid exiting the nozzles in each nozzle group so that they collide with less than 100% cross-over. The percentage cross-over may be between approximately 20% and 80%. In at least one embodiment, the percentage crossover may be between approximately 40% and 50%.

Preferably, the method may be applied to a shower head.

According to a third aspect of the present invention, there is provided spray head or spray head insert for use in at least one of a shower head, an industrial spray head and an agricultural spray head including a plurality of groups of nozzles, each group of nozzles having at least two nozzles that are suitable for providing turbulent fluid flow therein and for issuing jets of fluid from a surface of the spray head or spray head insert and are dimensioned and oriented, at least in use, so that fluid exiting the said at least two nozzles under pressure collides, interacts substantially unimpeded by surrounding structures and breaks into droplets, wherein in at least selected groups of nozzles, the jets collide at a percentage cross-over of less than 100%.

Preferably, the percentage cross-over may be less than 80% for all nozzle groups.

Preferably, the percentage cross-over is equal to or less than approximately 50% for all nozzle groups. The percentage cross-over may be greater than or equal to approximately 40% for all nozzle groups.

Further aspects of the present invention may become apparent from the following description, given by way of example only and with reference to the accompanying drawings.

MODES FOR PERFORMING THE INVENTION

The present invention relates to shower heads and may be particularly suitable for use as a shower head in a domestic shower. A shower head according to the present invention may provide advantages of a high quality shower experience for the user, the sensation of a higher volume flow than the shower head is actually providing and/or a high quality shower experience over a range of supply pressures.

Figure 1:
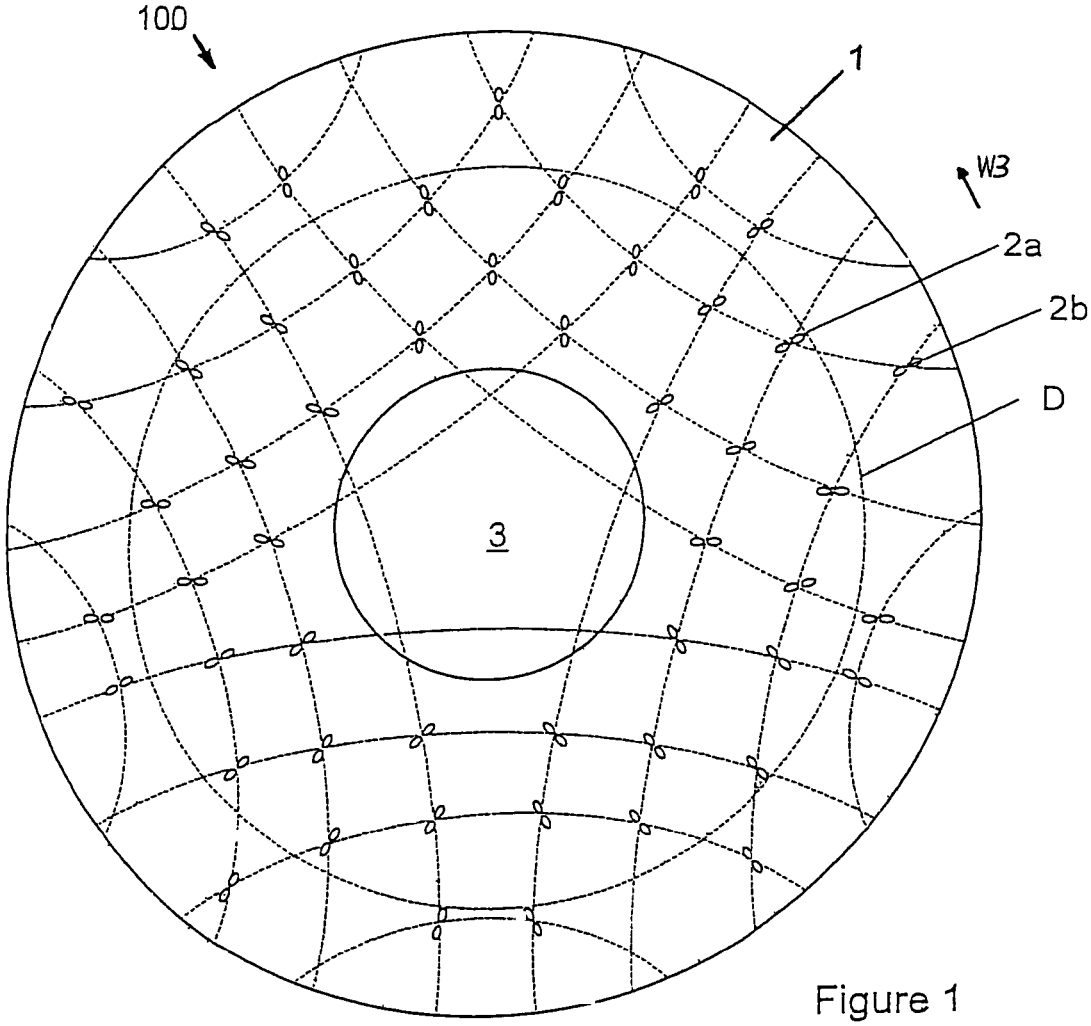
FIG. 1: shows a spray head insert according to a first embodiment of the present invention.

Referring to FIG. 1 of the accompanying drawings, a spray head insert according to a first embodiment of the present invention is shown and generally referenced by arrow 100. The spray head insert 100 may have particular application to a shower head and have advantages that particularly suit it to use as a shower head, but the application of the present invention is not limited solely to shower heads. For example, the spray head of the present invention may have application to industrial processes, including the application of paint or adhesive and/or to agricultural applications, including the application of herbicide or insecticide. It is anticipated that the present invention may have application where a soft spray, rather than a spray made up of a number of jets is required. The spray head 100 may be used as an emergency shower for treatment of burns victims immediately after the accident occurred.

Figure 3:
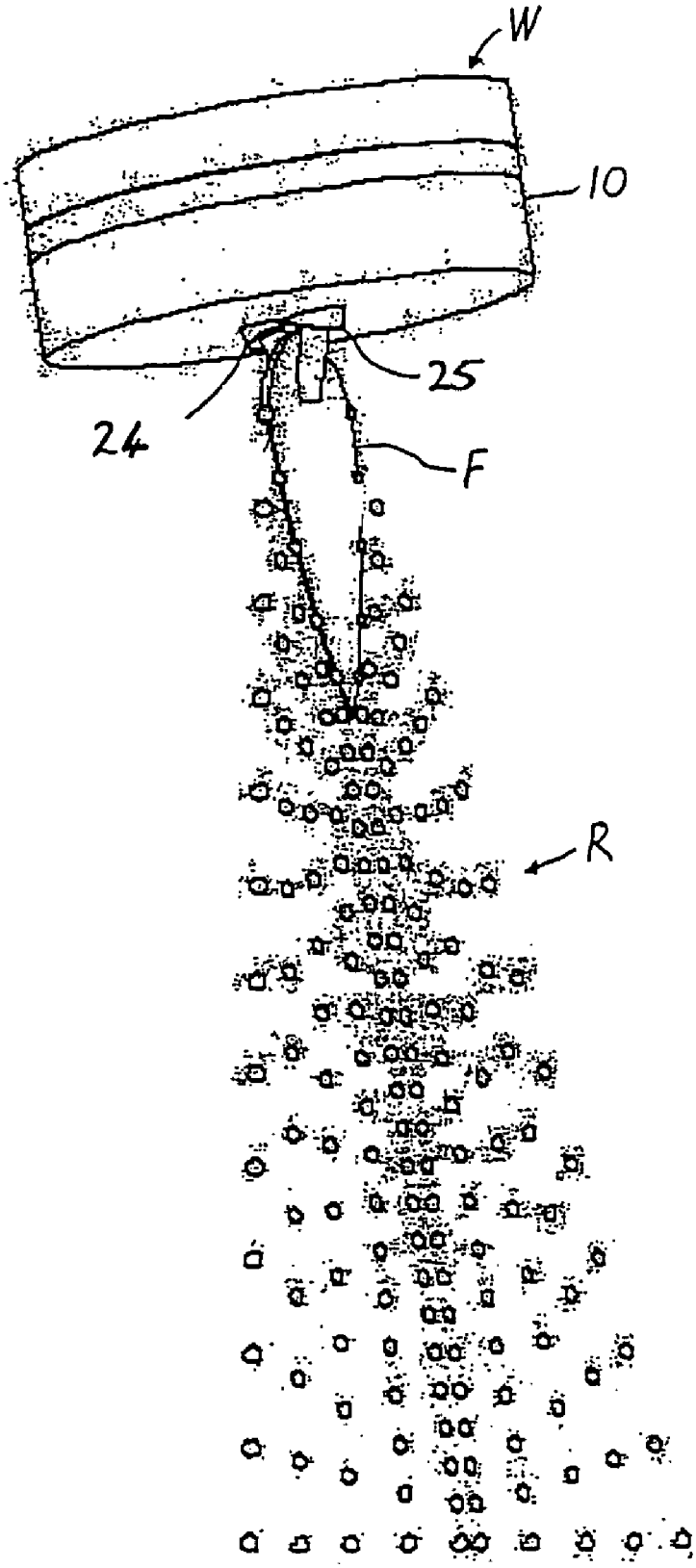
FIG. 3: shows a schematic representation of a spray produced by a nozzle group according to the present invention.

FIG. 3 shows a pattern of water resulting from the convergence of two fluid jets exiting from converging first and second nozzles 24, 25 provided in a base 10. The water initially forms a flame-like shape F and then breaks up into small droplets R. These droplets R may provide an improved showering experience and/or a spray suited to certain industrial or agricultural applications. Also, spray heads of the present invention may inherently have an ability to self-compensate for variations in supply pressure, as the changes in the droplet spray caused by variations in supply pressure are less noticeable compared to the changes in jets of water caused by the same variations in supply pressure.

Each nozzle group may optionally include three or more nozzles, although the preferred embodiment includes only two nozzles in each nozzle group. If a rotatable disk were provided behind the spray head 100, that sequentially opened and closed selected nozzles in nozzle groups, either partially or fully, a pulsating effect may be achieved or the direction of spray from each nozzle group varied.

As described in more detail herein below, the particular pattern of groups of nozzles over the shower head, the number and pattern of nozzles in each nozzle group and the nozzle dimensions and orientations may be varied depending on the requirements for the particular application of the spray head.

The spray head insert 100 shown in FIG. 1 has a base 1 in which in this embodiment is located forty-five groups of nozzles. The surface profile of the base 1 may be planar, or optionally include a non-planar profile, such as a convex profile, in order to assist in providing a required spray pattern. The base 1 may be annular, as shown in FIG. 1, or may have some other shape, for example rectangular, and may be constructed from any suitable material such as plastic, rubber or suitable metal or metal alloy.

In this embodiment, each group of nozzles consists of two nozzles. For clarity, only two nozzle groups are indicated by reference numerals in FIG. 1, nozzle groups 2*a* and 2*b*. The nozzle groups are distributed over the spray head insert 100 and located at the intersection of five groups of four arcs, shown in dashed lines, which are spaced equidistantly about the centre of the spray head insert 100. As shown in FIG. 1, each nozzle group may be oriented so that one nozzle is located approximately radially outward of the other nozzle in the nozzle group. Each nozzle may have a circular cross-section, although this is not essential. In one embodiment of the invention, the nozzles may be formed by simple apertures in the base 1.

The centre of the spray head insert 100 may include a massage unit 3, which produces a pulsating spray when water pressure is applied to the spray head 100. Massage units are well known and therefore the operation and implementation of the massage unit 3 will not be described further herein. Alternatively, the centre of the spray head insert 100 may be fixed and may be integral with the base 1. The centre of the spray head insert is not necessarily devoid of nozzle groups.

The spray head insert 100 in use will typically be secured and sealed about its periphery to a housing (not shown), together forming a spray head. Alternatively, the spray head insert 100 may be integrally formed with its housing. The housing will include or be connected to a fluid channel in which fluid can travel from a fluid supply to the housing and shaped to create a pool of water W (see FIG. 3) behind the spray head insert 100. The spray head insert 100 may be produced by an injection moulding process, with the nozzles created by pins that pull out of the mould after the moulding process.

By varying the geometry of the nozzle groups, control over the direction that the spray travels when exiting the nozzle group may be achieved. For example, the nozzle groups outside of a certain diameter D, such as nozzle group 2*b*, may expel spray from the nozzle with a component directed radially outwards, whereas nozzles inside the diameter D, such as nozzle group 2*a*, may direct spray along an axis substantially normal to the spray head insert 100. This variation in spray direction achievable by varying the nozzle characteristics may be used instead of, or in addition to, any variation in the profile of the surface of the base 1 in which the nozzles are located.

Figure 2:
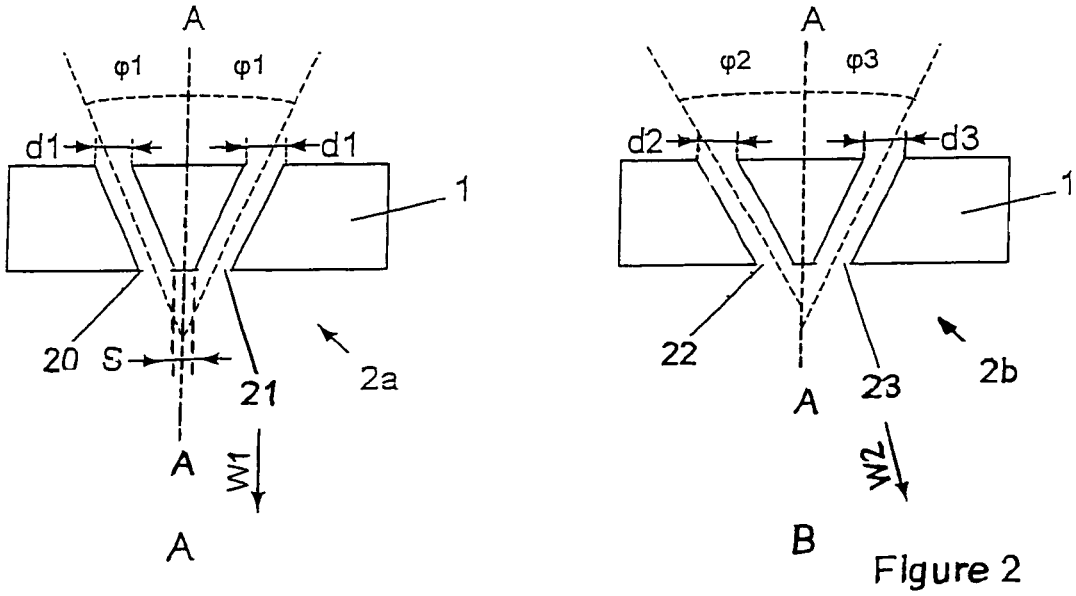
FIGS. 2A, B: are sectional views showing the relative orientation of nozzles in the spray head insert of FIG. 1 for inner nozzle groups and outer nozzle groups respectively.

Referring to FIG. 2A, a schematic cross-sectional view through the nozzle group 2*a* is shown. The nozzle group 2*a* includes first and second nozzles 20, 21 separated by a distance S. Although S may equal zero, the applicant has found that it is advantageous for S to be at least half the nozzle diameter. The maximum separation of nozzles in a group will generally be limited by the amount of space a nozzle group can occupy in the shower head without colliding with the flow from nozzles in other nozzle groups. Also, the further the nozzles are separated, the less tolerance there is to deviations in the direction of jets produced by the nozzles. Both nozzles 20, 21 are oriented at the same angle $\phi$1 relative to an axis normal to the shower head insert 100, a normal axis centered on the nozzle groups 2*a* and 2*b* indicated in FIGS. 2A and 2B by line AA. The angle $\phi$1 may suitably be 25° and therefore, the nozzles 20 and 21 are oriented 50° relative to each other (i.e., have an included angle 50°). More preferably, the angle $\phi$1 may be 35°, resulting in an included angle of 70°. Each nozzle may have a diameter d1 along its longitudinal axis of 0.8 mm. Due to symmetrical nature of the nozzle group 2*a*, water will be directed out of the nozzle in the direction indicated by W1, along the normal axis AA.

FIG. 2B shows a cross-sectional representation of the nozzle group 2*b*. The nozzle group 2*b* includes two nozzles 22 and 23. The nozzle 23 may have the same dimensions and orientation relative to the normal axis AA as nozzle 21 in nozzle group 2A, in which case d3=d1=0.8 mm and $\Phi$3=$\Phi$1=35°. The nozzle 22 may have an increased diameter d2, for example a diameter of approximately 0.9 mm or 1 mm and/or oriented at an increased angle $\psi$2 relative to the normal axis AA. The angle $\Phi$2 may, for example, be 40°. Therefore, due to the asymmetrical nature of nozzle group 2*b*, water exiting the nozzle group 2*b* will be directed approximately in the direction indicted by arrow W2. If required, selected nozzle groups may be oriented so that the water exiting the nozzle group has a component perpendicular to the directions W1, W2. For example, referring to nozzle group 2*a* in FIG. 1, the direction of travel of water from the nozzle group 2*a* may have a component in the direction W3. This is achieved by using a compound angle when creating the nozzles. In this case a nozzle will have its entrance and exit at different positions along the direction of W3. If both nozzles in a pair have the same compound angle added then the jets will collide and cause a spray with this added compound angle.

The relative included angle between the nozzles in a nozzle group is selected between a minimum angle that still achieves a breaking up of the jets from each nozzle into droplets and a maximum angle that still provides a required spray speed away from the spray head. It is anticipated that the included angle between nozzles may be anywhere between approximately 40° and 140° while still providing a suitable balance between the abovementioned requirements. Although a spray head of the present invention is anticipated to be usable over a wide pressure range, for example between 25-1000 kPa for the nozzle shown in FIG. 1, if necessary, high pressure and low pressure spray heads may be produced with differing included angles between the nozzles in each nozzle group. Producing spray having a variable speed away from the spray head across the spray head may be achieved by providing nozzle groups across the spray head with different angles of convergence.

Although only two different types of nozzle groups are described and shown in relation to the spray head insert 100, those skilled in the relevant arts will appreciate that other group types may be used to achieve another required angle of spray from the nozzle group and a single spray head may include two, three or more different types of nozzle group. One or both of the nozzle angle and nozzle diameter may be varied to achieve changes in spray direction.

Different spray patterns may be achieved by changing the distribution pattern of nozzle groups, changing the dimensions and orientation of nozzles relative to each other and relative to the axis normal to the spray head within a nozzle group, changing the orientation of the nozzles between nozzle groups and changing the surface profile of the base of the spray head. In addition, the orientation of the nozzle groups relative to the centre of the spray head may be changed. For example, in a rectangular spray head, all the nozzle groups may be aligned to be parallel to the longitudinal axis of the spray head. All of these variables may be considered for use when designing a spray head that needs to exhibit a particular spray pattern. In addition to using the aforementioned variables to determine the spray pattern from a spray head, the same variables may be used to control the concentration of fluid across the spray pattern. For example, the spray heads may be produced that provide uniform water concentration across the spray pattern or alternatively provide higher concentrations of fluid in some regions in comparison to others, such as in the centre in comparison to the periphery of the spray pattern or vice-versa.

The size of the fluid droplets may be influenced by the exit diameter of the nozzles, the included angle of nozzles in each nozzle group and the percentage cross-over. The percentage cross-over refers to the extent to which jets from nozzles in a nozzle group impact each other. Perfectly aligned nozzles have a cross-over percentage of 100%, whereas jets that miss each other entirely have a cross-over percentage of 0%.

Although the nozzles may be formed simply by cylindrical apertures in the base 1, this is not essential. For example, the nozzles may be shaped to have a throat near their exit.

Figure 4:
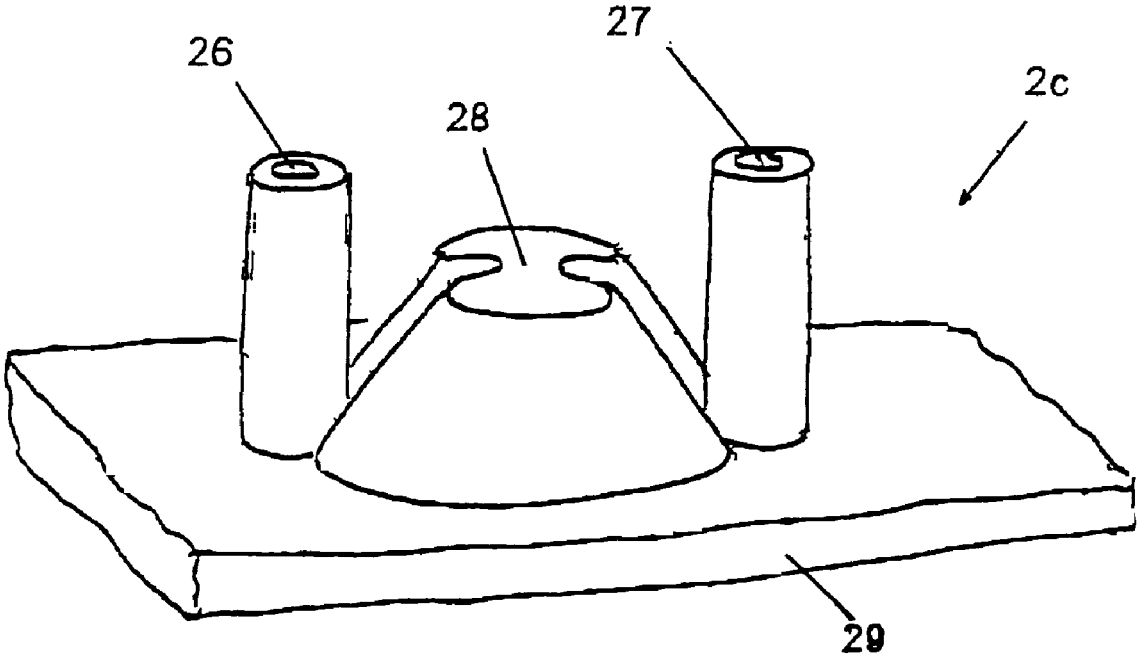
FIGS. 4A. B: show a nozzle insert for a spray head according to a second embodiment of the present invention.
Figure 4:
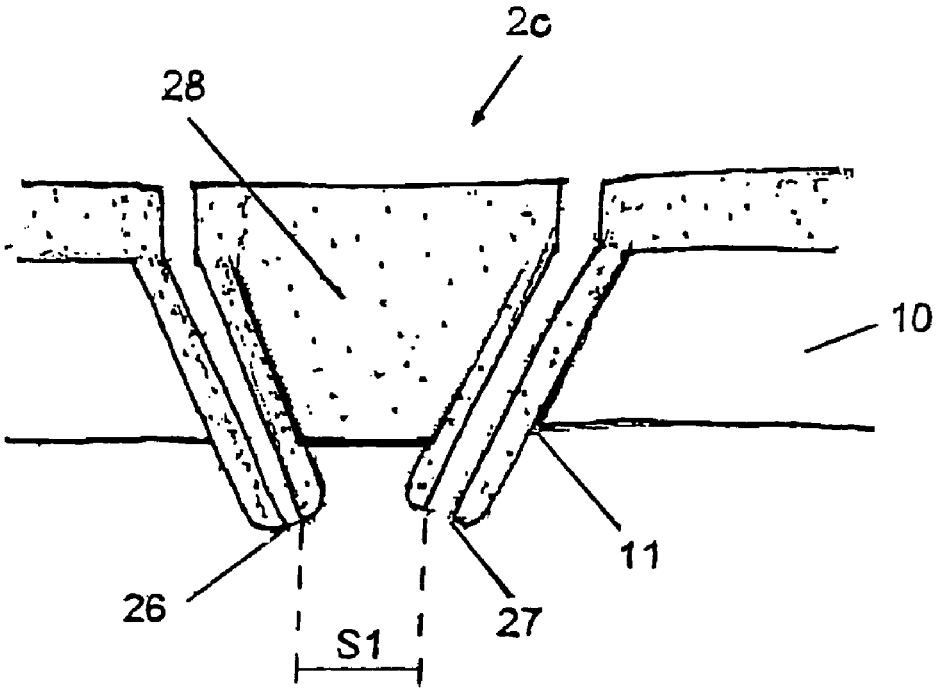

In a second embodiment of the invention, the nozzles may be a separate component engageable with the rest of the spray head. Also, the nozzles may be formed by discrete nozzles engaged with the base 1. An example of this embodiment is shown in FIGS. 4A and 4B. FIGS. 4A and 4B show a nozzle group 2*c* including two nozzles 26, 27. The nozzle group 2*c* is an integral moulded component, suitably of moulded rubber and is inverted and inserted into an aperture 11 in a base 10 (see FIG. 4B), the base 10 forming part of a spray head. A central support 28 sets the distance S1 between the nozzles 26, 27. The nozzles 26, 27 and support 28 extend from a foot 29, which abuts the inside surface of the base 10, assisting to prevent the nozzles 26, 27 being pushed through the aperture 11. Multiple groups of nozzles 2*c*, may extend from the same foot 29 and all the nozzles for a spray head may be provided on a single foot, forming an insert for a spray head base.

An advantage of the embodiment shown in FIG. 4B is that manufacture of the spray head may be simplified. Also, debris or scale that accumulates within the nozzles 26, 27 may be relatively easily removed in comparison to nozzles in the form of apertures in a rigid base material. This ability to clean the nozzles may be advantageous in a spray head of the present invention, as debris and scale may cause a jet of fluid exiting a nozzle to be misdirected, resulting in less than a required cross-over percentage, or in the most extreme cases resulting in jets missing each other entirely.

Figure 5:
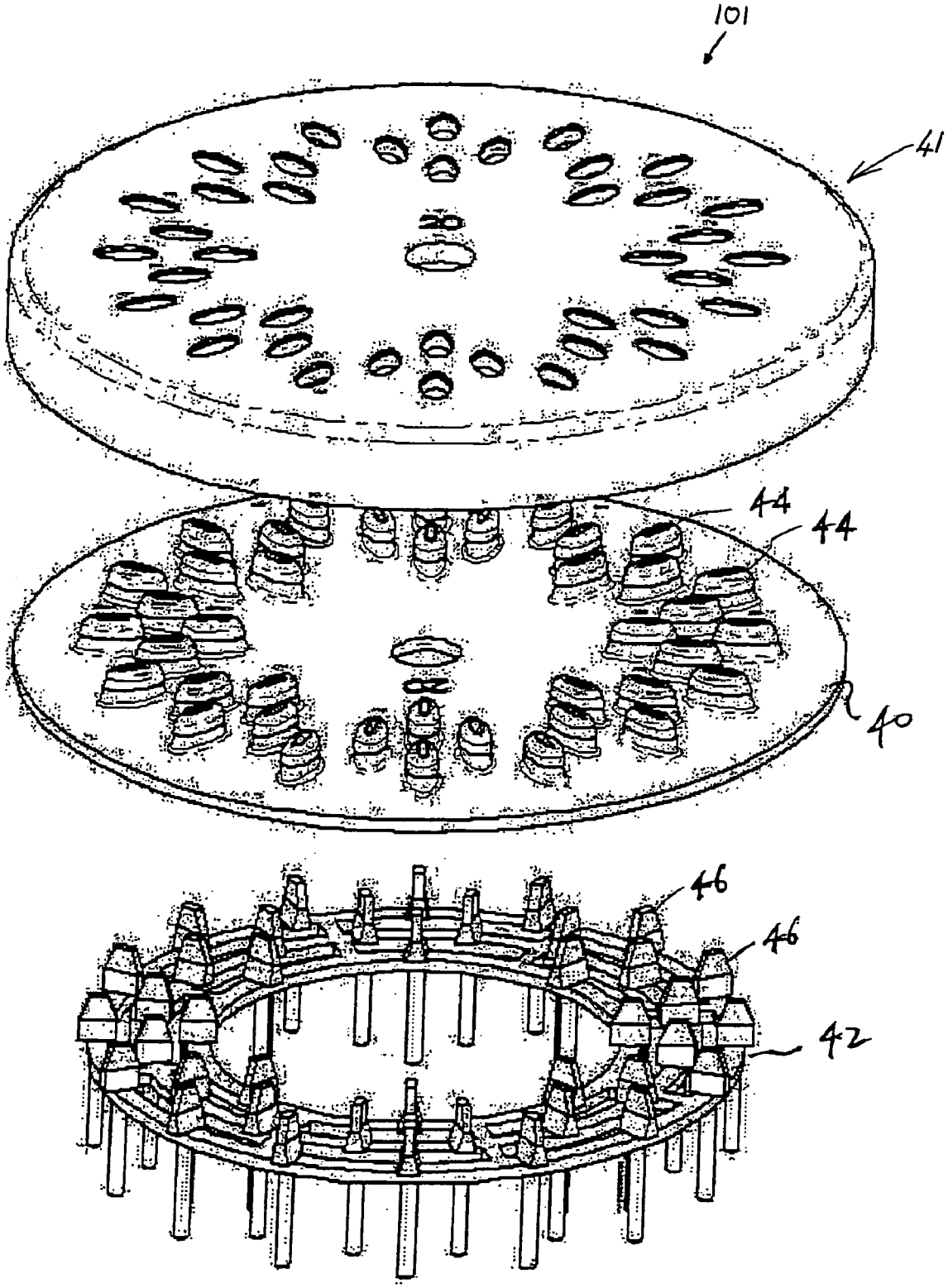
FIG. 5: is an exploded isometric view of a nozzle insert construction, together with a nozzle housing, according to a third embodiment of the present invention.

A third alternative embodiment is shown in FIG. 5, in which a spray head 101 is shown having two inserts comprising a first insert member 40, and a second insert member 42. The first and second insert members 40, 42 are provided in a housing 41. The first insert member 40 has a plurality of apertures 44, which correspond with the apertures provided in the housing 41. The second insert 42 has a plurality of projections 46, each of which in use locates within an aperture 44 of the first member 40.

Figure 6:
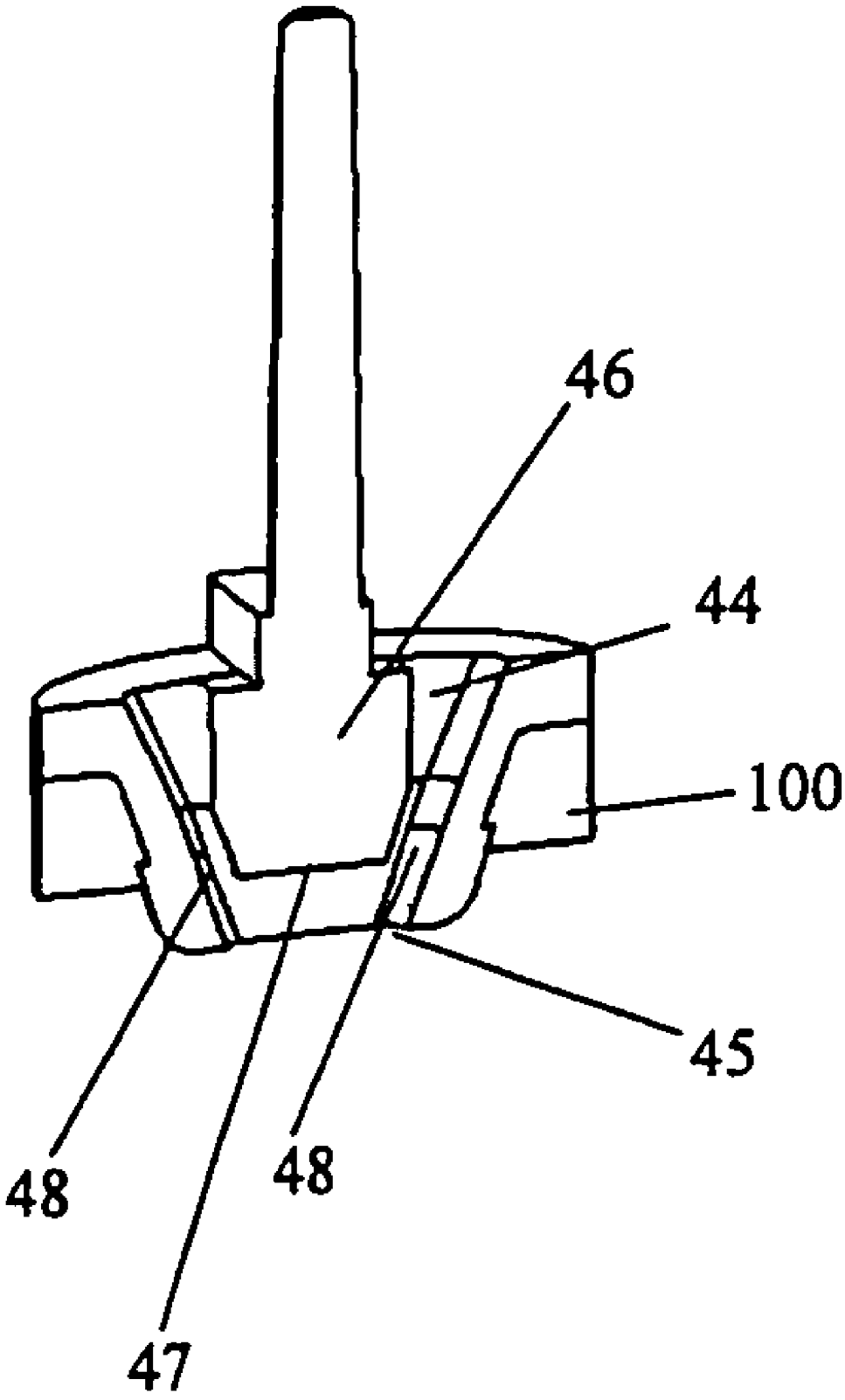
FIG. 6: shows a part of the nozzle insert construction of FIG. 5, in cross section.

The assembled arrangement can be more readily seen with reference to FIG. 6. The projections 46 are tapered to form a general wedge shape, which may be partly or wholly conical. The correspondingly tapered or conical aperture 44 includes two channels or grooves 48, which form nozzles. Alternatively, the apertures may be cylindrical or otherwise formed by parallel walls, creating slightly different jet characteristics. The material from which the first insert member 40 is constructed is preferably a resilient or flexible or elastic or similar material that enables a suitable seal to be made between a projection 46 and the side walls of the aperture 44.

The central portions of the projections 46 and apertures 44 may be shaped to locate the projections 46 properly in the apertures 44, maintaining the required cross-sectional area of the channels or grooves 48. This may be important to ensure a particular spray pattern and concentration of fluid across the spray pattern is achieved and maintained.

The base 47 of the projections 46 may align with the exit 45 of aperture 44. Alternatively, the base 47 may protrude from or, as shown in the example in FIG. 6, be recessed within the aperture 44. Also, the exit of the channels or grooves 48 may be aligned with, protruding from or recessed into the housing 41. If the base 47 is recessed, the aperture 44 and housing 41 should not constrain formation of the spray pattern that forms due to collision of the jets exiting the channels or grooves 48, as this may produce aerated water rather than a droplet spray. Similarly, whether or not the base 47 is recessed, the area outside of the exit of the channel or grooves 48 should be kept clear so as not to constrain formation of the spray pattern formed by the colliding jets.

An advantage with this embodiment is that the nozzle geometry is fixed into the tool at the time of manufacture, which makes the geometry more accurate and reliable under manufacturing conditions, so that the desired result of colliding fluid streams from the nozzles is more reliably achieved in the finished product. Another advantage is that the need for removable pins in the mould is avoided. Using removable pins to manufacture a spray head with many pairs of flow paths in close proximity, such as that shown in FIG. 1, can present difficulties. The first and second insert members 40, 42 can be produced using separate dies.

Figure 7:
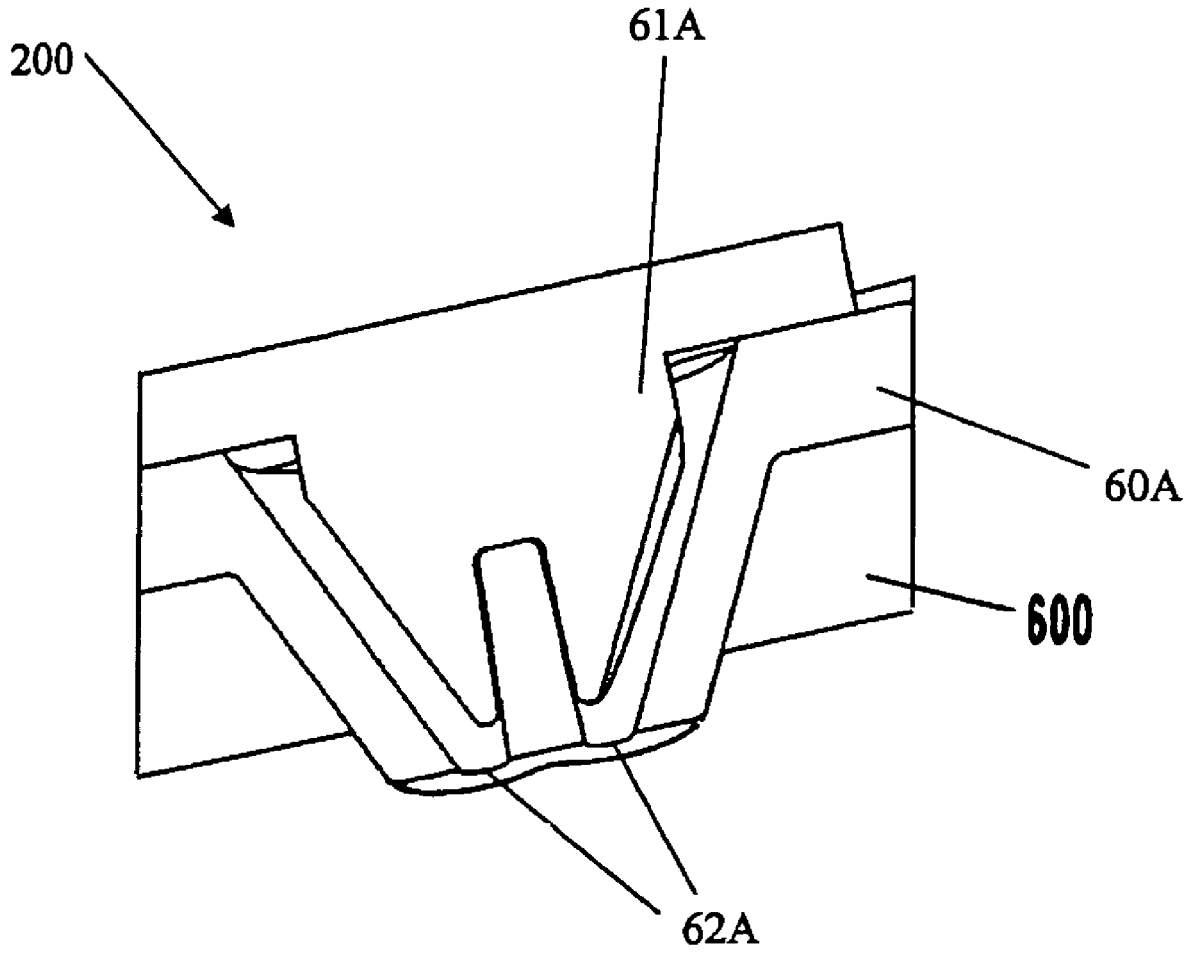
FIG. 7: shows a cut-away view through a nozzle construction according to a fourth embodiment of the present invention, formed by a faceplate and an insert.
Figure 8:
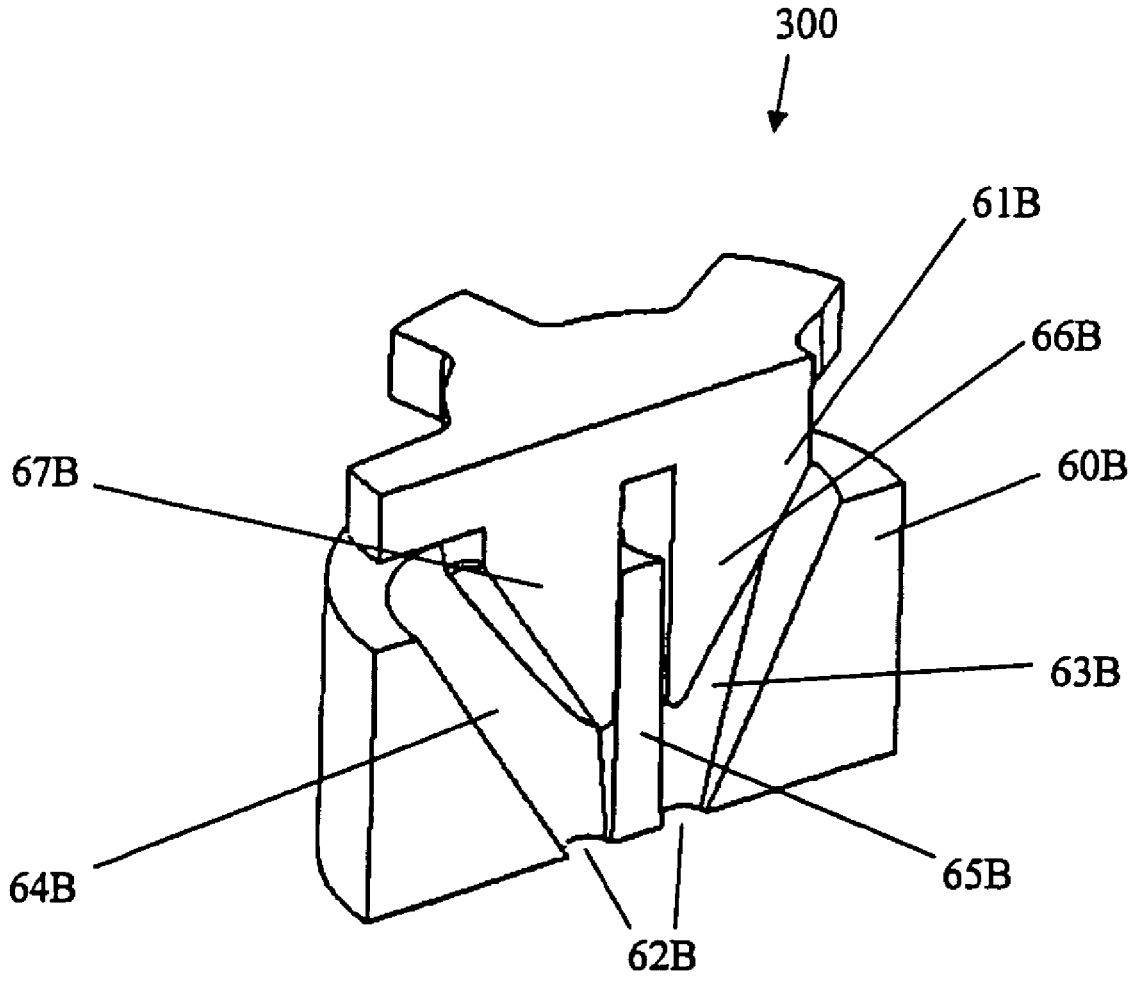
FIG. 8: shows a cut-away view through a nozzle construction according to a fifth embodiment of the present invention, formed by a faceplate and an insert.

FIGS. 7 and 8 both show fourth and fifth embodiments of nozzle constructions in accordance with the present invention. FIG. 8 shows an exploded view. The nozzle constructions, generally referenced by arrows 200 and 300 respectively, are constructed from a faceplate 60A, 60B and an insert 61A, 61B to form channels 62A and 62B respectively. Both FIGS. 7 and 8 show a cut-away view of the faceplate and insert, with the view taken through the two exit hole centres of the channels 62A and 62B.

The faceplate 60A for nozzle construction 200 may be constructed from a resilient or flexible or elastic material assembled (or moulded) behind a rigid plate 600. The exits of the channels 62A can then protrude from the rigid plate 600, allowing rubbing by the user to quickly clean the channels 62A of deposits, such as lime deposits, on the channel walls.

Referring to FIG. 8, the faceplate 60B includes two conical apertures 63B and 64B separated by a central column 65B. The insert 61B includes two conical protrusions 66B, 67B that blank off portions of the apertures 63B and 64B respectively. The shape of the conical protrusions 66B and 67B result in jets that collide with each other at a greater relative angle than if the conical protrusions 66B and 67B were not provided. The tips of the conical protrusions 66B and 67B may be rounded to increase their robustness. The rounded tips, if located appropriately, may also increase the relative angle of the jets issuing from the channels 62B. FIG. 7 has a similar construction but with slightly different dimensions. The faceplate 60B may optionally also be made from a flexible material, which can then be assembled behind a rigid plate in a similar manner to faceplate 60A in FIG. 7.

In a preferred form of the invention, the included angle of the fluid channels 62A, 62B is between 70 and 85 degrees, the exit holes have a 1 mm diameter and a 40% cross-over. The distance from centre to centre of the exit holes may be 1.5 mm and the vertical length of the conical holes 4 mm. Some versions of this embodiment may be made such that the fluid issues perpendicular to the local exit surface, however by adding a compound angle to the construction of the nozzle, the fluid can be made to issue at a number of degrees off the perpendicular vector. The Applicant has found it preferable for optimisation of size and uniformity of spray to use an angle of 6-8 degrees on some nozzle groups on the faceplate.

Figure 9:
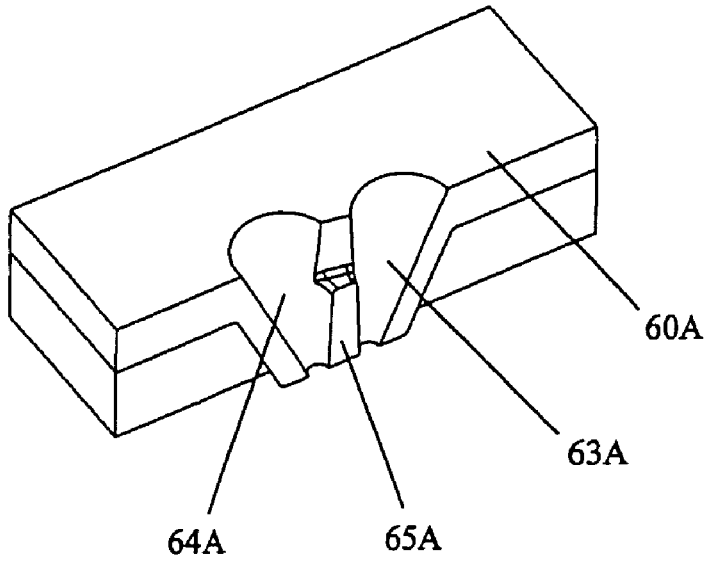
FIG. 9: shows a cut-away view through the insert of the nozzle construction shown in FIG. 7.

FIG. 9 shows a cutaway view of the faceplate 60A, which includes two conical apertures 63A and 64A separated by a central column 65A.

Figure 10:
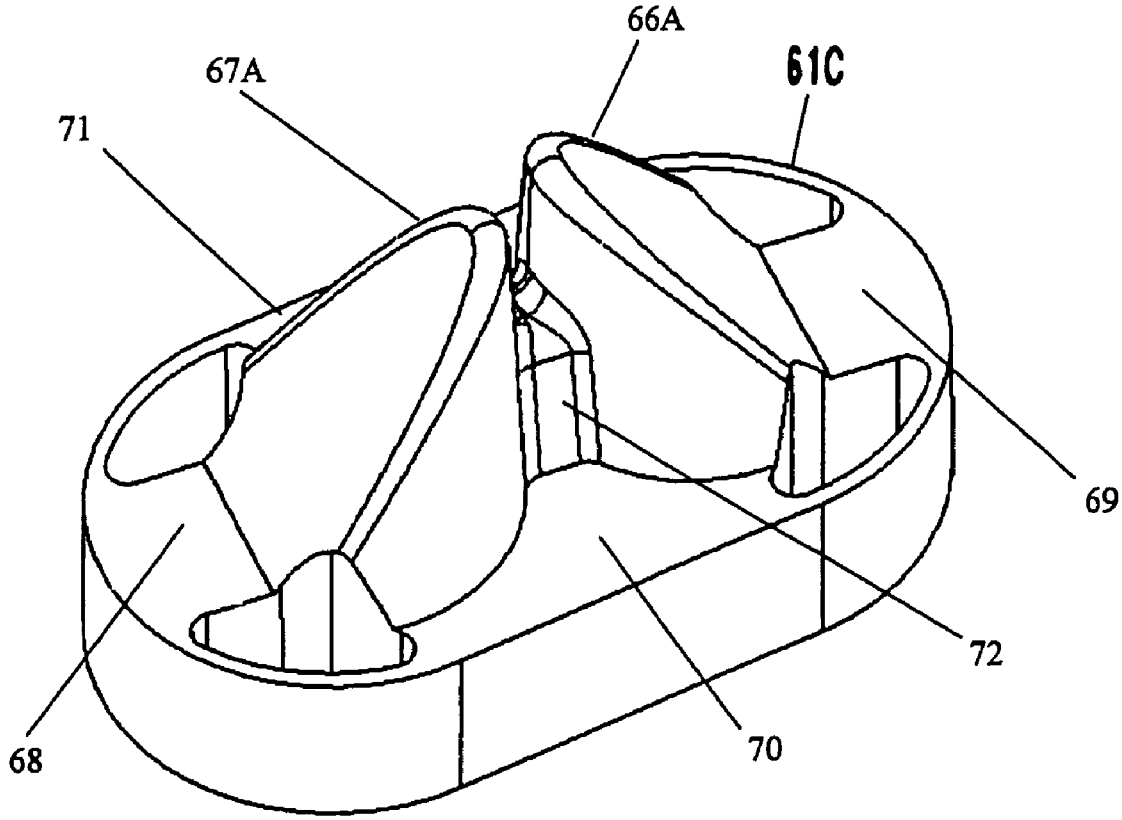
FIG. 10: shows a possible insert to achieve a spray perpendicular to the faceplate and provide a cross-over percentage (see herein below) less than 100%.

FIG. 10 shows a view of an alternative insert 61C, showing one nozzle group only. The insert 61C includes two conical protrusions 66A and 67A. These are supported by four webs 68-71. A fifth web 72 joins the two conical protrusions. The webs 68-71, in addition to supporting the conical protrusions 66A and 67A act as baffles in the fluid flow path. The webs 68-71 therefore create turbulence in the flow, which the Applicant has found assists in forming droplets after the jets collide, at least for some configurations of nozzle construction. The Applicant believes that laminar flow in the jets tend to cause the flame F (see FIG. 3) to combine back into a stream, whereas turbulent flow in the jets causes the flame to disintegrate into droplets. Accordingly, if the fluid flow paths are otherwise designed so as to create a turbulent flow, then use of webs or other suitable means to create turbulence may not be necessary. The insert 61A shown in FIG. 7 and 61B in FIG. 8 acts in a similar manner to insert 61C, but has some geometric differences.

An advantage of the nozzle constructions shown in FIGS. 7 to 10 may again be in ease of manufacture. The apertures 63A, 64A, 63B and 64B may be formed relatively easily in comparison to moulding around removable pins. Also, a large number of impinging jet pairs can be provided in a relatively small space. Another advantage is that cleaning is simplified, as the faceplate and insert can be separated, providing access to the surfaces of each. The nozzle construction shown in FIGS. 7 and 10 may be preferred when a more robust insert is required, the insert gaining strength from the web that connects the two conical protrusions and the resulting insert may also be easier to manufacture and assemble.

The apertures in the faceplate are not necessarily conical. In an alternative embodiment, the apertures may be rectangular at the entry, tapering down to an exit hole positioned so as to create the required slope in the fluid flow path. Inserts are provided for the rectangular apertures in a similar manner as for the conical apertures.

Figure 11A:
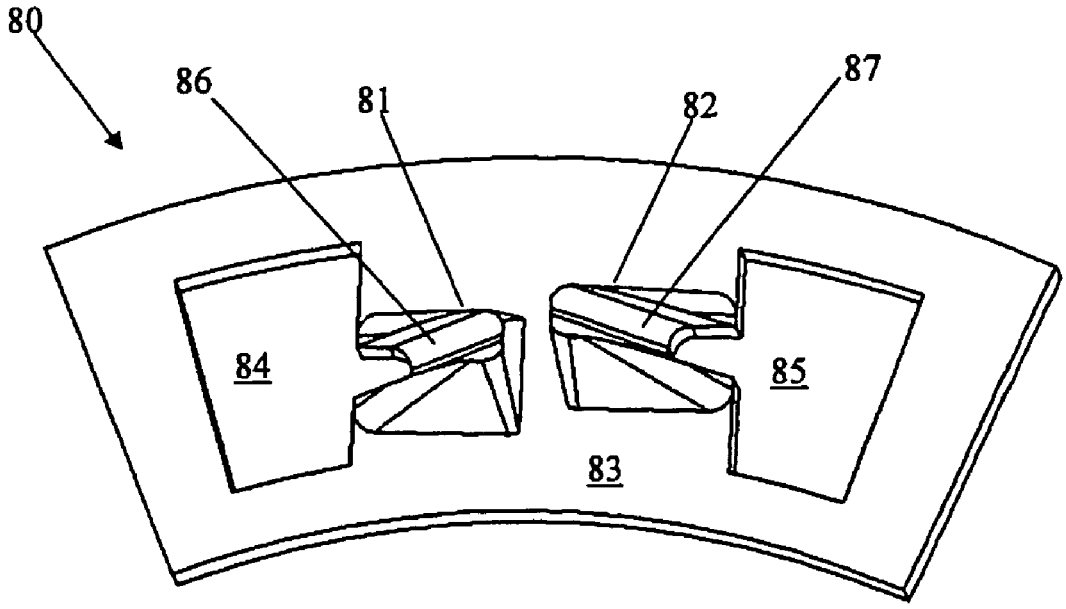
FIGS. 11A, B: shows a perspective view and plan view respectively of a possible configuration of insert to provide a cross-over percentage (see herein below) less than 100%.
Figure 11B:
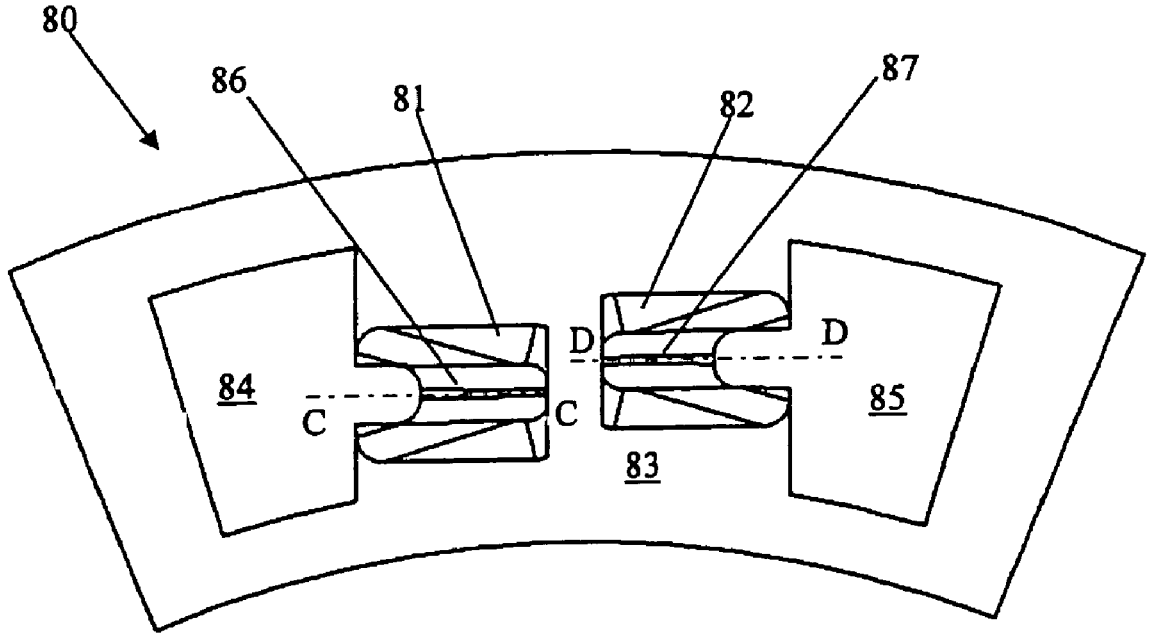

FIGS. 11A and 11B show in detail two parts of an insert 80. The insert 80 has two protrusions 81 and 82 extending from the insert base 83. Two apertures 84 and 85 provide a fluid flow path through the insert base 83. The protrusions 81 and 82 both include a channel, referenced 86 and 87 respectively along which fluid travels before being ejected as a jet. This configuration allows the protrusions 81 and 82 to abut the inner surface of an aperture provided on a corresponding faceplate, which may provide for more consistency in the cross-sectional area of the flow path through each nozzle than if channels 86 and 87 were not provided.

If each channel is symmetrical about a centreline through its own footprint, then the spray from the colliding jets will issue substantially perpendicular to the insert base 83. The nozzles may also have a compound angle added to alter the direction of the resulting spray. This is achieved by making the channels 86 and 87 coincident with planes that have the centrelines CC and DD (see FIG. 11B) as centres of rotation, these planes must be parallel for the jets to collide with the same crossover that is present at the nozzle exits. The compound angle can also be applied to the other embodiments described herein. The jet issuing from a nozzle exit will in these cases be parallel with the line between hole centres at the entrance and exits of the nozzle. Hence the angle of the fan created by the collision of the jets can be controlled by altering the position of the entrance hole relative to the exit hole.

Figure 12:
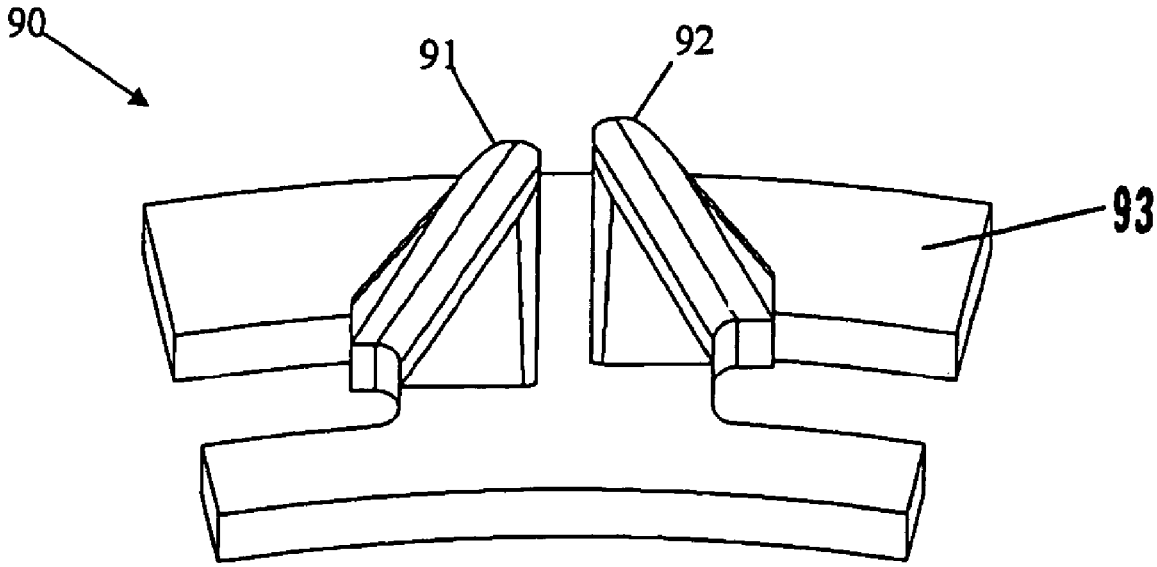
FIG. 12: shows a perspective view of a possible configuration of insert using compound angles to achieve a spray issuing at an angle to the face plate.

FIG. 12 shows an alternative insert 90 that employs the compound angles discussed above. The insert 90 includes two protrusions 91 and 92 that extend from the insert base 93 on a slope. By providing sloped protrusions 91 and 92, the direction of issue of the spray from the nozzles can be controlled.

The Applicant has found that the embodiments shown in FIGS. 11 and 12 produces a turbulent stream of fluid through the nozzles, avoiding the need for additional webs to create turbulence.

Both FIGS. 11A and 11B show that the centrelines, referenced CC and DD in FIG. 11B, of the nozzles that are formed by the insert 80 are not perfectly aligned, leading to a cross-over percentage less than 100%. Similarly, the nozzles formed by insert 90 (see FIG. 12) are not perfectly aligned. The Applicant has found that if the nozzles are aligned so as to provide substantially 100% cross-over, a fine spray can be produced in addition to the droplets. The fine spray may be present outside of the spray area formed by the droplets. This fine spray may not be conductive to an optimum spray and may irritate the face and/or eyes of the person taking the shower. If the cross-over percentage is less than 100%, then the occurrence of this fine spray is reduced. The cross-over percentage may preferably be in the range of approximately 20% to 80%. Reducing the cross-over percentage may also provide improved spray characteristics for the embodiments described in relation to FIGS. 7-10.

The most preferred nozzle embodiment is in the form shown in FIGS. 9 and 10. The included angle of the fluid channels created is between approximately 70 and 85 degrees. The exit holes are about 1 mm in diameter and have a 40% cross-over. The distance from centre to centre of the exit holes is about 1.5 mm. The vertical length of the conical holes is about 4 mm. While some nozzles in this embodiment may be made so that fluid, once it has collided, issues substantially parallel to the axis of the showerhead, some nozzles in the preferred embodiment may include a compound angle. The currently preferred compound angles create an angle of issue of spray in between 6 and 8 degrees from perpendicular to the spray head.

In an alternative embodiment, the cross-over percentage may be varied and/or the exit diameter of the nozzles varied. For example, half the nozzle groups may have nozzles with a 0.8 mm exit diameter and have a 50% cross-over and the other nozzles may have a 1 mm exit diameter with a 40% cross-over. The 1 mm and 0.8 mm nozzles may be evenly distributed over the spray head. In this embodiment the spray produced may contain varying droplet sizes, although the Applicant believes that there is an average effect in the sensation felt by a person in the spray.

Figure 13:
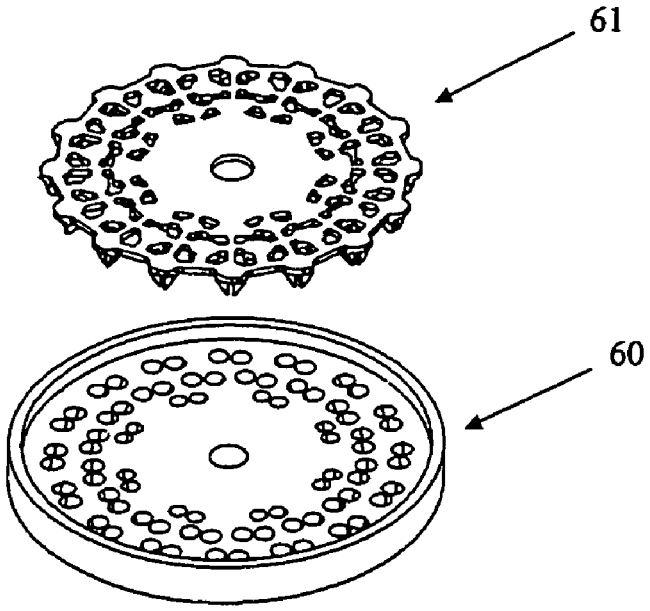
FIG. 13: shows a perspective view of an insert and faceplate and configuration of nozzles of a spray head according to a sixth embodiment of the present invention.
Figure 14:
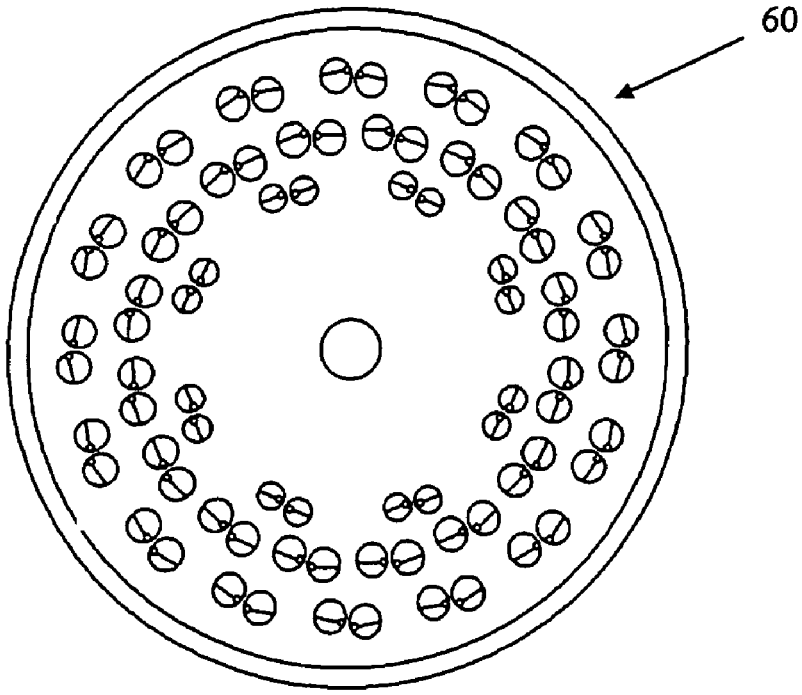
FIG. 14: shows a plan view of the face place shown in FIG. 13 as seen from the entry side of the nozzles.

FIG. 13 shows a full view of an insert 61 and a faceplate 60. The insert 61 slots into the faceplate 60. Although shown as a single unit in FIG. 12, the insert 61 may alternatively be made up of a plurality of parts. FIG. 14 shows a plan view of the faceplate 60.

In one embodiment, the insert 61 is movable relative to the faceplate 60, allowing a user to adjust the characteristics of the spray by altering the flow area in the flow-path and hence the pressure drop across the system. The jet collision angle and the turbulence in the fluid flow is also altered. The user may therefore be able to control the quality of the spray, including such factors as droplet size, concentration and speed, as well as total spray area.

Figure 15:
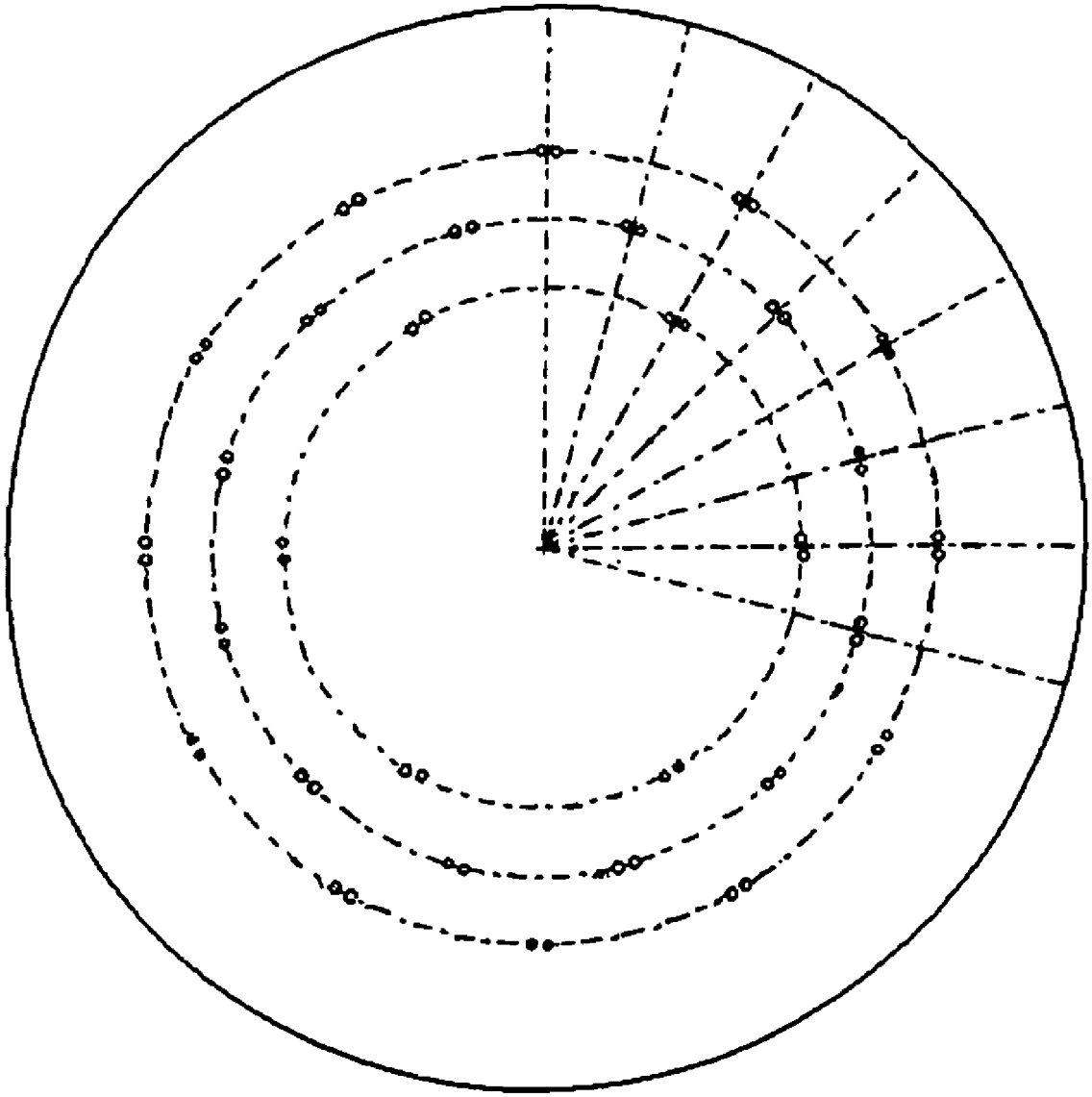
FIG. 15: shows a plan view of the faceplate shown in FIG. 13 as seen from the exit side of the nozzles.

FIG. 15 shows a plan view of the faceplate 60 from the exit side of the nozzles. The nozzle pattern shown in FIG. 15 is the most preferred pattern identified for a shower head. There are three concentric rings of nozzle groups, with a total of 30 nozzle groups. The inner ring sprays perpendicular to the axis of faceplate, the middle ring sprays with a component radially outward at an angle of 6 degrees from the perpendicular. The outer ring sprays with a component radially outward at an angle of 8 degrees from the perpendicular line. Each ring of nozzles is offset from the adjacent ring by half a pitch angle to reduce interference of the sprays with each other. All holes have 1 mm diameter exit and all nozzle pairs have a 40% crossover.

Where in the foregoing description reference has been made to specific components or integers of the invention having known equivalents then such equivalents are herein incorporated as if individually set forth.

Although the invention has been described by way of example and with reference to possible embodiments thereof, it is to be understood that modifications or improvements may be made thereto without departing from the scope of the invention as defined in the appended claims.

The invention claimed is:

1. A spray head for use in at least one of a shower head, an industrial spray head and an agricultural spray head comprising a plurality of groups of nozzles, wherein each of said groups of nozzles comprises at least two nozzles that are suitable for issuing jets of fluid from a surface of the spray head and are dimensioned and oriented so that fluid exiting the at least two nozzles under pressure collides, interacts substantially unimpeded by surrounding structures and breaks into droplets, wherein each nozzle is formed at least in part by an aperture through a faceplate, wherein entrances and exits of the nozzles in at least selected ones of said nozzle groups are offset relative to each other so that fluid issues from the at least selected nozzle groups at an angle of between approximately 6 and 8 degrees to an imaginary line at a nozzle group normal to the surface of the spray head, and wherein at least one selected nozzle group is configured so that fluid exiting the at least two nozzles of the selected group under pressure collides with between 20% and 80% crossover.

2. A spray head for use in at least one of a shower head, an industrial spray head and an agricultural spray head comprising a plurality of groups of nozzles, each of said groups of nozzles having at least two nozzles that are suitable for issuing jets of fluid from a surface of the spray head and are dimensioned and oriented so that fluid exiting the at least two nozzles under pressure collides, interacts substantially unimpeded by surrounding structures and breaks into droplets, wherein each nozzle is formed at least in part by an aperture through a faceplate, wherein at least one selected nozzle group is configured so that fluid exiting the at least two nozzles of the selected group under pressure collides with between 20% and 80% crossover, wherein each said nozzle group is formed by two apertures and complimentary protrusions, and wherein the protrusions act as a blank for each said aperture, thereby increasing an included angle of the jets issuing from the nozzles in the nozzle group.

3. The spray head according to claim 2, wherein each said aperture is substantially conical in shape.

4. The spray head according to claim 2, wherein the protrusions are movable relative to the apertures to allow control over characteristics of spray produced by the spray head.

5. The spray head of claim 4, wherein the apertures for a plurality of the nozzle groups are all formed in a single base material.

6. A spray head for use in at least one of a shower head, an industrial spray head and an agricultural spray head comprising a plurality of groups of nozzles, each of said groups of nozzles having at least two nozzles that are suitable for issuing jets of fluid from a surface of the spray head and are dimensioned and oriented so that fluid exiting the at least two nozzles under pressure collides, interacts substantially unimpeded by surrounding structures and breaks into droplets, wherein each nozzle is formed at least in part by an aperture through a faceplate, wherein at least one selected nozzle group is configured so that fluid exiting the at least two nozzles of the selected group under pressure collides with between 20% and 80% crossover structured to create, in use, turbulent fluid flow in each said nozzle, and wherein each said nozzle includes at least one baffle to create the turbulent fluid flow.

7. A spray head comprising a faceplate and an insert for the faceplate, the faceplate having a plurality apertures therethrough and the insert having a plurality of protrusions extending therefrom, wherein the insert is located relative to the faceplate so that the protrusions at least partially enter said apertures, whereby the protrusions and the apertures together define a plurality of groups of at least two nozzle that are configured for issuing jets of fluid from a surface of the faceplate and are structured so that fluid exiting the said at least two nozzles under pressure collides, interacts substantially unimpeded by surrounding structures and breaks into droplets, and wherein at least one selected nozzle group is configured so that fluid exiting the at least two nozzles of the selected group under pressure collides with between 20% and 80% crossover.

8. The spray head of claim 7, wherein the protrusions and the apertures are distributed over substantially the entire area occupied by said faceplate and said insert.

9. The spray head of claim 7, wherein a plurality of the protrusions and the apertures are located at a different radius from a center of the spray head than a plurality of other of the protrusions and the apertures.

10. The spray head of claim 7, wherein the protrusions and the apertures are located in one of three concentric rings.

11. A method of manufacturing a spray head, including forming a faceplate with a plurality of apertures therein, forming a insert for the faceplate having a plurality of protrusions extending therefrom and providing a housing to receive liquid from a positive pressure liquid supply, and supplying said liquid at pressure to the insert and faceplate, wherein the insert is locatable relative to the faceplate so that the protrusions at least partially extend into said apertures, whereby the protrusions and the apertures together define a plurality of groups of at least two nozzles that are configured for issuing jets of liquid received from the housing from a surface of the faceplate and are dimensioned and oriented, at least in use so that fluid exiting the said at least two nozzles under pressure collides, interacts substantially unimpeded by surrounding structures and breaks into droplets, and whereby at least one selected group of the nozzles is configured so that fluid exiting the at least two nozzles of the selected group under pressure collides with between 20% and 80% crossover.

12. A spray head comprising a rigid plate and an insert for the rigid plate made from a flexible material, the rigid plate having a plurality of apertures therethrough and the insert having a plurality of protrusions that extend through the rigid plate when the spray head is assembled, whereby the protrusions have at least one aperture therethrough, that optionally together with a second insert, define at least two nozzles that are configured for issuing jets of fluid therefrom, wherein when the spray head is assembled that at least two nozzles are oriented and dimensioned so that fluid exiting the said at least two nozzles under pressure collides, interacts substantially unimpeded by surrounding structures and breaks into droplets, and wherein at least one selected nozzle group is configured so that fluid exiting the at least two nozzles of the selected group under pressure collides with between 20% and 80% crossover.

* * * * *